US006075318A

United States Patent [19]

Noll et al.

[11] Patent Number: 6,075,318

[45] Date of Patent: Jun. 13, 2000

[54] HALOGEN INCANDESCENT LAMP HAVING A SOCKET

[75] Inventors: Thomas Noll, Kipfenberg; Roland Stark, Wellheim, both of Germany

[73] Assignee: Patent-Treuhand-Gesellschaft fuer elektrische Gluelampen mbH, Munich, Germany

[21] Appl. No.: 09/037,602

[22] Filed: Mar. 10, 1998

[30] Foreign Application Priority Data

Mar. 11, 1997 [DE] Germany ..... 197 09 928

[51] Int. Cl.[7] ..... H01J 17/20; H01J 61/12; H01J 5/48; H01J 5/50

[52] U.S. Cl. ..... 313/573; 313/318.07; 313/318.09; 313/578; 439/619; 439/699.2

[58] Field of Search ..... 313/318.01, 318.07, 313/318.09, 318.1, 318.12, 573, 578, 580, 624–26, 634; 439/619, 699.2

[56] References Cited

U.S. PATENT DOCUMENTS

| | | | |
|---|---|---|---|
| 3,480,816 | 11/1969 | Fallon | 313/51 |
| 3,500,105 | 3/1970 | Westlund, Jr. | 313/318 |
| 4,295,076 | 10/1981 | Eckhardt | 313/223 |
| 4,489,252 | 12/1984 | Eckhardt | 313/318.07 |
| 4,630,880 | 12/1986 | Durand | 339/176 L |
| 4,717,852 | 1/1988 | Dobrusskin et al. | 313/25 |
| 4,791,335 | 12/1988 | Lin | 313/318 |
| 4,877,992 | 10/1989 | Devir | 313/318 |
| 5,018,992 | 5/1991 | Bergin et al. | 313/318.1 X |
| 5,495,138 | 2/1996 | Behr et al. | 313/318.1 X |
| 5,672,077 | 9/1997 | Wang et al. | 439/619 |
| 5,685,638 | 11/1997 | Huang | 313/318.09 X |
| 5,701,051 | 12/1997 | Lin | 313/318.09 X |
| 5,969,469 | 10/1999 | Wang | 313/318.1 |

FOREIGN PATENT DOCUMENTS

| | | |
|---|---|---|
| 0652610 | 5/1995 | European Pat. Off. . |
| 0668639 | 8/1995 | European Pat. Off. . |
| 21068 | 1/1900 | Germany . |
| 2056671 | 5/1972 | Germany . |
| 2810402 | 1/1979 | Germany . |
| 8131006 U | 2/1983 | Germany . |
| 9102566 U | 5/1991 | Germany . |
| 9201057 U | 5/1993 | Germany . |
| 195 21 735 | 1/1996 | Germany . |
| 296 07 132 U | 7/1996 | Germany . |
| 2087663A | 5/1982 | United Kingdom . |

*Primary Examiner*—Nimeshkumar D. Patel
*Assistant Examiner*—Mack Haynes
*Attorney, Agent, or Firm*—Carlo S. Bessone

[57] ABSTRACT

The invention relates to a system composed of a halogen incandescent lamp and a matching socket, substantial advantages with regard to environmental friendliness and cost being achieved by using a high-voltage or medium-voltage halogen incandescent lamp having a simple glass cap and by holding the lamp in the socket on the glass cap, without the safety aspect being neglected.

5 Claims, 10 Drawing Sheets

HALOGEN INCANDESCENT LAMP HAVING A SOCKET

TECHNICAL FIELD

The invention relates to a halogen incandescent lamp and a socket which matches it. High-voltage/medium-voltage lamps having a socket associated therewith are concerned. The socket can be embodied, in particular, as an adapter for conventional sockets. For this purpose the adapter may be equipped with, for example, an E27/E14 screw cap, bayonet cap or the like.

BACKGROUND OF THE INVENTION

EP-A 652 610 has disclosed a low-voltage (LV) incandescent lamp which is pinched at one end and uses a glass cap, in which the supply leads are bent over by 180° directly on the broad sides of the pinch and bear against them. Elastic clamp contacts arranged in the socket permit two-point holding.

EP-A 668 639 likewise describes a socket for a low-voltage incandescent lamp pinched at one end and having contact springs of complicated configuration and a plurality of wedge-shaped projections on the broad sides of the pinch, the supply leads also resting on these wedge-shaped projections.

Finally, DE-A 28 10 402 has disclosed a socket for a low-voltage incandescent lamp, pinched at one end, for use with a printed circuit board, the supply leads being guided away laterally at right angles from the pinch of the lamp for the purpose of making contact on the printed circuit board.

Halogen incandescent lamps are spreading increasingly into many different spheres of life, for example into the lighting of houses and flats, in vehicles, in the industrial field etc. Their advantages are the small overall size, the increased light yield, the good color rendition, as well as the service life, which is longer by comparison with conventional incandescent lamps. For the most part, it is low-voltage halogen lamps, for example with an operating voltage of 12 V or 24 V, which are used in this case. In recent years also some medium-voltage and high-voltage halogen incandescent lamps have been appearing on the market.

Pin-type lamps having a pinch at one end are used in the case of the low-voltage halogen incandescent lamps. As holding and contact elements straight, pin-shaped supply leads project straight out of the side of the pinch averted from the lamp. The assigned sockets are consequently essentially characterized by two holding openings having integrated spring-loaded pin contacts for the pin supply leads. Because of the low operating voltage, there is no need for a safety device against touching the live parts. These lamps are very compact.

By contrast therewith, the known medium-voltage and high-voltage halogen incandescent lamps which are pinched at one end preponderantly use additional outer bulbs having a conventional medium-voltage (MV) or high-voltage (HV) standard cap. They are even mandatory in the case of screw caps for safety reasons. Serving, frequently, as connecting part between the lamp and outer bulb, on the one hand, and the standard cap, on the other hand, is a ceramic part into which the lamp and outer bulb are cemented. Fastening the ceramic part to the standard cap is likewise performed, as a rule, by cementing, bonding or crimping. To eliminate the risk of bulb explosion at the end of the service life, one to two fuses are connected between the supply lead and cap contacts. The halogen incandescent lamp is thereby of the same external configuration as a conventional incandescent lamp for this voltage range (at least 80 V; typical values for MV are 100 to 120 V, and for HV 220 to 250 V), and is also essentially exactly the same size. The reason for this is the safety requirements (shock protection in the corresponding voltage range; anti-explosion protection) and the stipulations, owing to the widespread luminaires, with respect to the standard cap, as well as the requirement for exchangeability between the conventional lamp and halogen incandescent lamps. HV/MV lamps are significantly more expensive both by comparison with the corresponding conventional incandescent lamps and by comparison with LV halogen incandescent lamps having a transformer, because of these design features. Their market share has therefore so far been relatively low. On the other hand, there have not so far been any compact high-voltage/medium-voltage halogen incandescent lamps at all on the market.

SUMMARY OF THE INVENTION

The invention is based on the technical problem of providing as compact as possible a system which is composed of a halogen incandescent lamp and socket for HV and MV. A further object is to provide a halogen incandescent lamp and a matching socket or a system which, on the one hand, lead to improved environmental protection and, on the other hand, to savings in costs.

The invention is thus based on the idea to make MV/HV lamps which are as compact as possible in that, also in the case of these lamps, glass caps are used. Under specific preconditions, in this case it is even possible without substantial safety risks to dispense with the use of fuses for avoiding bursting of lampbulbs at the end of the service life. This can be achieved, in particular, by means of suitably shaped supply leads. Examples are described in German Utility Model 91 02 566 (the supply lead is spiraled and forms a blow-out channel in the pinch) and in German Utility Model 296 07 132 (the supply lead is a thin unspiraled wire with a diameter of at most 200 $\mu$m, in particular 130 $\mu$m). Explicit reference is made to these publications.

According to the invention, use is made of a halogen incandescent lamp which is pinched at one end and designed for the medium-voltage/high-voltage range and whose pinch is constructed as a glass cap having two narrow sides and two broad sides. The system comprises overall a halogen incandescent lamp pinched at one end and an assigned socket, the lamp being a high-voltage/medium voltage halogen incandescent lamp having a lamp axis, whose pinch is constructed as glass cap having external supply leads situated essentially on the side of the glass cap averted from the lamp, the socket having an insertion opening for the lamp, a mechanical holding device for holding the lamp on the glass cap and metallic contacts for making electric contact with the supply leads of the lamp.

The external supply leads of the lamp are bent over by at least approximately 90°. The electric contacts of the socket in one embodiment make contact with the supply leads in the bent-over region. It has proved to be thermally favorable when the bend of the supply lead is arranged at a spacing from the glass cap. A particularly stable arrangement in mechanical terms is one in which the supply lead is guided back after the bend as far as the glass cap and, in particular, bears against the narrow side of the pinch. A high degree of compactness can be achieved when the electrical contacts of the socket contact the supply leads in the region of the free, guided-back ends thereof.

In this case the holding device cooperates with a holding means, in most cases with a recess and/or a projection on the glass cap in the manner of a latching holder.

Projecting from the glass cap are supply leads of the lamp which are situated essentially on the side of the glass cap averted from the lamp, that is to say essentially "at the bottom", when the lampbulb with the incandescent wire is "at the top".

Furthermore, it is provided in a preferred embodiment that, by contrast with the low-voltage halogen incandescent lamps and their sockets, it is not the supply leads and assigned holding bores, but rather the region of pinch situated "thereabove" itself which is used as the holder contact between lamp and socket. With the lamp mounted in the socket, the supply leads are correspondingly situated "below" the pinch or the mechanical holder. They lie thus deeper in the socket than in the case of LV systems. The glass cap and the holder thus contribute, in accordance with the invention, to covering the live parts. For this purpose, essential parts of the supply leads are arranged below the pinch, while, frequently, in the case of glass cap lamps for LV operation, they are bent directly at the end face of the pinch towards the broad sides thereof.

An essential point of consideration concerns the contact points between the supply leads and the corresponding metal mating contacts of the socket. Because the lamp is already held on the glass cap, it is possible (by comparison with the pin-type lamps) to configure the shape of the supply leads, which are arranged essentially below the glass cap, and the shape of the socket such that the contact points have a certain spacing from the glass cap. As a result, there is a marked reduction in the thermal loading of the contact points and thus of their oxidation. This advantage also holds by comparison with the conventional standard caps described above since, owing to their shape and solid design, the latter cause a comparatively very intense conduction of heat to the contact points.

On the other hand, the possibility is thereby produced of fitting the metal contacts in the socket at so large a spacing that it is impossible to erroneously make contact with LV lamps whose pin spacings are less than 6.35 mm.

In order to realize this, the supply leads of the lamp are bent over by at least approximately 90° towards the narrow sides. This bend has the effect firstly of increasing in a simple manner the distance between the metal contacts of the socket. As a result, a protection is realized against the inadvertent use of a low-voltage halogen incandescent lamp with the resulting danger of explosion. Owing to the changed contact spacing, it is impossible with a low-voltage halogen incandescent lamp having a standardized spacing between the supply leads for simultaneous contact to be produced with both contacts of the socket, and this eliminates the risk of accidents.

In spite of this, in the case of the lamp itself, the spacing between the supply leads in the pinch and immediately in front thereof outside its end face can be held to the standard spacing of 6.35 mm introduced with low-voltage halogen incandescent lamps. Moreover, this standard spacing has become established for the halogen incandescent lamps in the high-voltage range which are used in outer bulbs and auxiliary standard caps. The lamps in accordance with the invention can therefore continue to be produced at low cost with the machinery already available and then, by a simple bending over of the supply leads, the spacing between the contact regions and the supply leads can be enlarged. By contrast with LV halogen incandescent lamps, bending over in the case of HV halogen incandescent lamps represents no problem, since the molybdenum wires used typically have a diameter of less than 0.5 mm. By the bending over outwards, the spacing of the contact regions is increased by at least 10% over LV lamps, corresponding to a spacing of the contacts in the socket of more than 7, preferably more than 8, and particularly preferably more than 9 mm.

Finally, a certain spring action of the supply lead is achieved by bending over, especially when the end of the supply lead is guided back as far as the pinch. The contact making between the supply lead and the mating contact of the socket is thereby improved and can therefore be carried out by simple touching. In this case of a contact making by touching it is advantageous to configure the mating contact of the socket essentially in a flat fashion, for example, as a leaf spring, so that it does not hold the supply lead, while the contact area of the supply lead is chosen to be as large as possible in that it is more or less flat (plane or slightly bent).

Depending on whether the contacts of the socket are provided in the insertion direction of the lamp in front or laterally next to the supply leads, it can be sensible in this regard to extend the bend by conspicuously more than 90°, for example 180°. In particular, the supply lead can be bent over in a rounded shape, that is to say it can point back with its free end to the glass cap. Moreover, it can be advantageous if the supply lead bent back in such a way is situated for the purpose of stabilization with its end in a recess, for example in a groove in the narrow side of the glass cap. In order to support the said spring action, a free spacing from the glass cap should be left in this case in the direction of the respective spring. For example, this direction is the longitudinal direction of the lamp when the metal mating contacts are situated in front of the supply leads, seen in the direction of insertion of the lamp.

Alternatively or in addition, a spring action can also be obtained by resilient mating contacts of the socket. The service life and the reliability of the contacts is increased when the mating contacts on the socket side are provided with separate springs, in particular with helical springs. In order—possibly in addition to the stabilization in the recess of the glass cap explained above—to better guide the supply lead when producing the contact between the supply lead and the mating contact on the socket side, a guide device, for example a shaft, can be positioned in front of the mating contact of the socket, for example, by appropriately constructing the housing of the socket.

A high degree of compactness and reliable contacting are achieved by virtue of the fact that both the holding and the contact making are achieved by spring forces of resilient means which act axially or transverse to the axis.

The resilient means is, in particular, a single helical spring or leaf spring which cooperates with the electric contact such that it simultaneously ensures both the holding and the electric contact making.

In another variant, the resilient means for holding is a resilient holding clamp, while the resilient means for contacting is a helical spring. In this case, a recess and a projection can be situated next to one another on the glass cap, and the clamping spring is designed for the purpose of engaging into the recess beyond the projection.

In a first embodiment, the system is designed such that the lamp has been inserted inclined with respect to the longitudinal direction of its end position and has been latched, rotating about an axis transverse to the longitudinal direction of the lamp, into a latching holder cooperating with a projection on a narrow side of the glass cap.

In a second embodiment, the lamp is inserted in the longitudinal direction of its end position and is latched, rotating about its longitudinal direction as axis of rotation, into a latching holder cooperating with a projection on the glass cap, the latching holder being arranged, in particular, in a cover of the socket.

In a third embodiment, the lamp is inserted in the longitudinal direction of its end position, and is thereby latched into a latching holder cooperating with a recess and/or with a projection on the glass cap or the external supply lead.

Fundamentally, according to one of the various embodiments, the system can also be configured such that the socket is constructed as an adapter having a standard cap (screw cap or bayonet cap) for high-voltage/medium-voltage lamps.

The basic concept of the socket according to the invention for holding a high-voltage/medium-voltage halogen incandescent lamp having a glass cap is based on the following features: an insertion opening matched to the glass cap, a mechanical holding device, suitable for holding the lamp on the glass cap, and metallic contacts suitable for making electric contact with supply leads of the lamp on the side of the glass cap averted from the lamp.

This basic concept permits a clear distinction from sockets for LV lamps, by virtue of the fact that the spacing between the metal mating contacts is at least 7 mm wide. In the case of the LV lamp it is at least 10% smaller.

Advantageously the socket comprises at least two parts having riveted or crimped joints. As a result, it is possible to use different material for the parts (a material which can be subjected to high thermal loads, for example ceramic, is more favorable on the lamp side), on the one hand, and socketing of the springs and contacts in the socket is made easier, on the other hand.

The socket can additionally be provided with an open jacket bulb, in particular an opal screen, UV filter screen, color filter screen, a transparent luminaire cover or an outer bulb.

The socket is advantageously equipped with guide grooves or guide shafts for the supply leads of the lamp, which are arranged next to the contacts of the socket.

A suitable halogen incandescent lamp pinched at one end is an MV/HV halogen incandescent lamp whose pinch is constructed as a glass cap and whose supply leads are, in particular, bent over by at least approximately 90° such that the supply leads are situated essentially on the side averted from the lamp in front of the glass cap.

In particular, the lamp is equipped with a recess and/or a projection for latching a complementary latching holder of a socket.

The supply leads are advantageously bent over at a spacing from the glass cap and, in particular, are guided back as far as the glass cap. High stability and good contact making are achieved when the ends of the bent-over supply leads are embedded in grooves on the narrow sides of the glass cap.

The glass cap offers various design possibilities in order to optimize the mounting and the seating in the holder of the socket. Even a simple glass cap, with a rectangular cross-section, for example, can be gripped straight away in a stable and secure fashion by a clamp or a positive fit which is part of the socket.

The above possibilities opened up by the invention produce substantial advantages with regard to the problem addressed by the invention. Thus, by comparison with low-voltage systems it is possible to dispense with the transformer, and this renders the luminaires not only smaller and much more cost-effective but, with regard to their limited service life, also more environmentally friendly, of course. This results from eliminating the refuse burden represented by the transformer and by the outlay on material connected with it. Furthermore, a possible source of defects, and thus of a premature end to the service life of the luminaire as a whole is eliminated. In addition, the humming during dimmed operation, which frequently occurs with inexpensive transformers, is avoided.

By comparison with the conventional systems for medium-voltage and high-voltage operation, there is a considerable reduction in the price of the halogen lamps owing to the replacement of the conventional standard cap by the glass cap. In addition, the outer bulb, which has been mandatory to date in the case of screw caps, can now be omitted. There is an analogous reduction in the outlay on material and assembly and on the incidence of refuse.

The systems of pin-type lamps widespread in the low-voltage range are unsuitable for the medium-voltage and high-voltage range because of safety reasons.

Very small lampbulbs are provided by the invention for the medium-voltage and high-voltage range, however, without safety risks so that extraordinarily compact luminaire designs are rendered possible. The reason for this is not only the reduced lamp size, but also the possibility which is provided—essentially by the elimination of the standard cap described—of designing very compact lamp sockets.

With regard to the formulation of the problem for the invention, there is a further configuration according to the invention in an adapter solution to the conventional standard caps in the medium-voltage/high-voltage range, that is to say, for example, to the well-established E11, E14, E26, E27, B15*d* or B22*d* caps. The socket according to the invention is then connected to an appropriate standard cap, or has an appropriate standard cap. As a result, the system according to the invention can in practice be retrofitted to all luminaires with standard caps which are well-established and in use. As a result, luminaires operated to date with the conventional medium-voltage/high-voltage halogen incandescent lamps or with halogen-free incandescent lamps can also be retrofitted, with the result that the user profits from the advantages of the halogen lighting or from the cost advantages of the invention, and safety and environmental protection are satisfied.

A particular advantage of the system according to the invention is that the costs of replacement lamps will be so low that they hardly differ any longer from the prices of conventional incandescent lamps. Thus, a substantial increase in the market share of halogen incandescent lamps is made possible. The socket/lamp system according to the invention even can be designed to be so small that by contrast with conventional incandescent lamps or conventional halogen incandescent lamps with standard caps the design volume is reduced. As a result, retrofitting is possible virtually in an unlimited fashion in all luminaires.

Advantageous embodiments of the socket are designed in a cement-free fashion and the required joints are designed to be plugged, riveted, crimpled, clamped or similar. The freedom from cement benefits environmental protection and, moreover, the separation of materials is facilitated upon disposal. Moreover, the soldering of eyelets and side contacts, which is usually carried out with lead-containing solder in the case of HV/MV halogen incandescent lamps is advantageously switched to an environmentally friendly joining technology, such as laser welding, for example. In particular, joining rivets in the socket can be of hollow design and serve as screw holes or bolt holes through which the socket is joined to the described adapter part or to a luminaire.

Finally, the socket may be provided with an integrated screen, for example with an opal, UV filter or color filter screen, or with a transparent luminaire cover or with a screwed-on auxiliary protective bulb, for example as shock protection or for aesthetic reasons. In the last-named instance, the invention can lead, in the case of the adapter solution described, to a lamp which resembles the conventional medium-voltage/high-voltage halogen incandescent lamp, but can be dismantled and is largely reusable.

A further attractive advantage of the adapter solution with screw cap according to the invention consists in that it is possible by means of a suitable increase in diameter of the adapter directly above the screw cap (generally designated as overhang) for the mandatory shock protection to be integrated into the adapter without an outer bulb being required for this as in the prior art. To date, this shock protection has been realized in a very complex fashion in the case of conventional halogen incandescent lamps having a screw cap by fitting an outer bulb which, in this case, simultaneously also functions as protection against touching the actual lampbulb.

Because it is now possible to dispense with the outer bulb, the novel adapter solution with a suitable diameter results in enormous cost advantages in the case of screw cap adapters. Additional savings result in the case of raw materials and in the production process. Furthermore, the recyclability of the products is improved and environmental pollution is reduced.

The inherent safety is achieved by virtue of the fact that the overhang of the adapter now always reliably screens the side contact in the standard cap so that it is impossible when exchanging a lamp inadvertently to reach live parts with the finger. By contrast, it was possible earlier to touch live parts inadvertently in the case of a burst or disconnected outer bulb.

Whereas a conventional lamp having a diameter of the cap which is sufficiently large for shock protection (corresponding to the now possible overhang) would be very expensive and therefore not competitive, in the case of the adapter solution according to the invention the relatively expensive adapter with sufficient overhang, that is, large diameter, has to be purchased only when the system is purchased for the first time. After this, the low-cost purchase of a spare lamp with glass cap is always sufficient.

It is provided according to the invention to hold the lamp in the socket by means of its glass cap. It is preferred in this case to use a latching holder in the case of which at least one recess and/or at least one projection on the glass cap cooperates with at least one complementary element in the socket. Particular consideration is given in this case to snap-fit or bayonet joints. Such a latching holder is particularly effective when a projection and a recess are situated next to one another on the glass cap and the latching holder grips beyond the projection into the recess, in order to hold the lamp. This has the particular advantage that an integral construction (preferred in any case) of the projection or the recess on the glass cap is facilitated by virtue of the fact that the material displaced from the recess serves to build up the projection. Thus, during production there is no need either to remove material or to apply it, and the latching holder can latch over a distance corresponding to the sum of the height of the projection and the depth of the recess.

In the case of all the variants of the holder and, in particular, of the latching holders, it is preferred for reasons of safety that the socket has an insertion opening for the lamp which, taking account of the possibility of easy insertion, is largely adapted to the cross-sectional profile of the glass cap and holder, possibly reaching up to the insertion opening. A double-T cross-sectional profile of the pinch (and of the glass cap formed therefrom) is preferred in this case, which on the one hand permits good guidance in the insertion opening and, on the other hand, permits good stability of the glass cap. Since the glass cap is held in accordance with the invention by the holder, its stability is more important than in the case of conventional halogen incandescent lamps.

Various possibilities exist for inserting the lamp and the latching holder, of which the following are preferred and are illustrated in more detail in the exemplary embodiments.

Firstly, the lamp can be inserted somewhat obliquely with respect to its final position and already be pressed in the process against the contacts of the socket in order then, if appropriate against the spring force of the socket contacts, to be guided into the latching holder by a rotary movement about an axis extending transverse to the longitudinal direction of the lamp. For this purpose, at least one recess or at least one projection is situated on at least one of the sides of the glass cap which is lateral in the sense of rotation, for example the narrow sides of a glass cap having a rectangular cross-sectional profile. In this case, the latching can consist simply in that the spring force of the contacts on the socket side presses the lamp by means of one or more projections into a recess on the socket which is laterally open for insertion, and thus lock it therein.

Another alternative consists in a socket corresponding to a bayonet cap, in which the direction of insertion and the longitudinal direction of the lamp coincide during insertion and in the end position, and the lamp is latched in the socket, in a fashion rotating about its longitudinal direction, in a way similar to that just described.

Finally, it is particularly preferred to dispense entirely with a rotary movement and simply to insert the lamp into the end position in its longitudinal direction and latch it directly by means of the insertion movement. A spring means (generally a snapaction spring or leaf spring) in the socket which cooperates with the projection/recess combination outlined can be used, in particular, in this case.

Independently of the precise configuration of the contacts and the holder, it is preferred that the lamp can easily be exchanged without further dismantling measures by simply removing the lamp from the socket or inserting it into the socket. This only requires the lampbulb to be gripped and moved in a fashion, that is, resembling the case of an LV halogen incandescent lamp having a pin cap.

It is pointed out as a precaution that the above-mentioned individual features explained in conjunction with the exemplary embodiments can also be essential to the invention in other combinations or in each case per se. In particular, the features described here of lamps, sockets, or systems formed therefrom can be applied not only to the specific field of application of medium-voltage/high-voltage halogen incandescent lamps but also to other lamps. This holds, on the one hand, generally for halogen incandescent lamps of all types, but also for other lamps such as discharge lamps, in particular low-wattage metal halide lamps having bulbs pinched at one end as described, for example, in the U.S. Pat. No. 4,717,852.

Furthermore, it is pointed out that the subject-matter of this application, in particular in combination with the subject-matter of German Utility Model 296 07 132 or of German Utility Model 91 02 566 of the same applicant, develops particular advantages. The teaching disclosed there of so configuring the internal supply lead that it acts as an inherent fuse renders possible halogen incandescent lamps which can be operated without separate fuse, since they do not explode upon failure. In the present connection, this has the advantage that the sockets, adapters and/or luminaires can be operated without fuse and that, in particular, fitting cannot be done erroneously with regard to the power rating of the lamp and the fuse.

BRIEF DESCRIPTION OF THE DRAWINGS

The invention is to be explained in more detail below with the aid of a plurality of exemplary embodiments which are illustrated in the attached figures, in which.

BEST MODE FOR CARRYING OUT THE INVENTION

Figure 1:
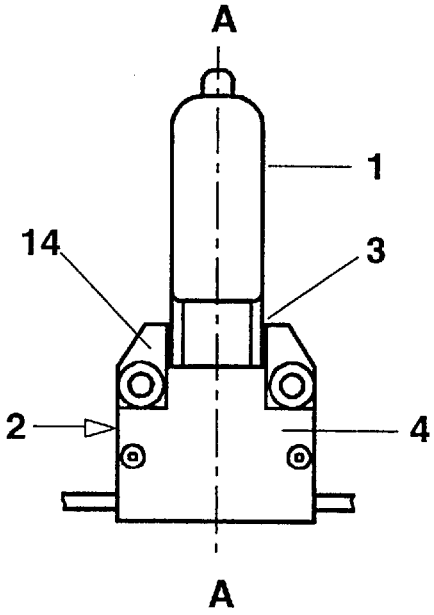
FIG. 1 shows a side view of a system composed of a lamp and socket according to a first exemplary embodiment.
Figure 3:
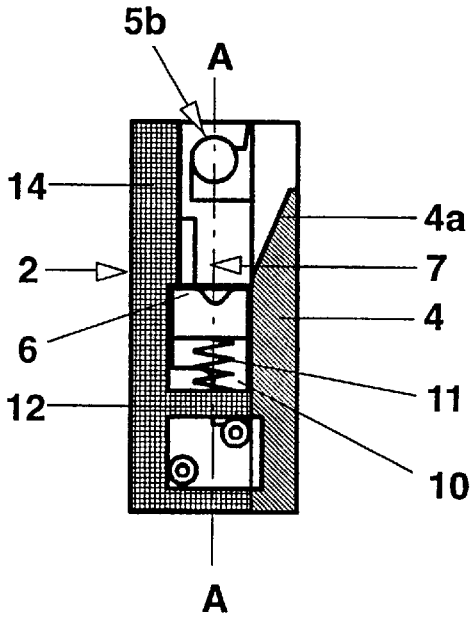
FIG. 3 shows a longitudinal section according to the section III—III in FIG. 2.
Figure 2:
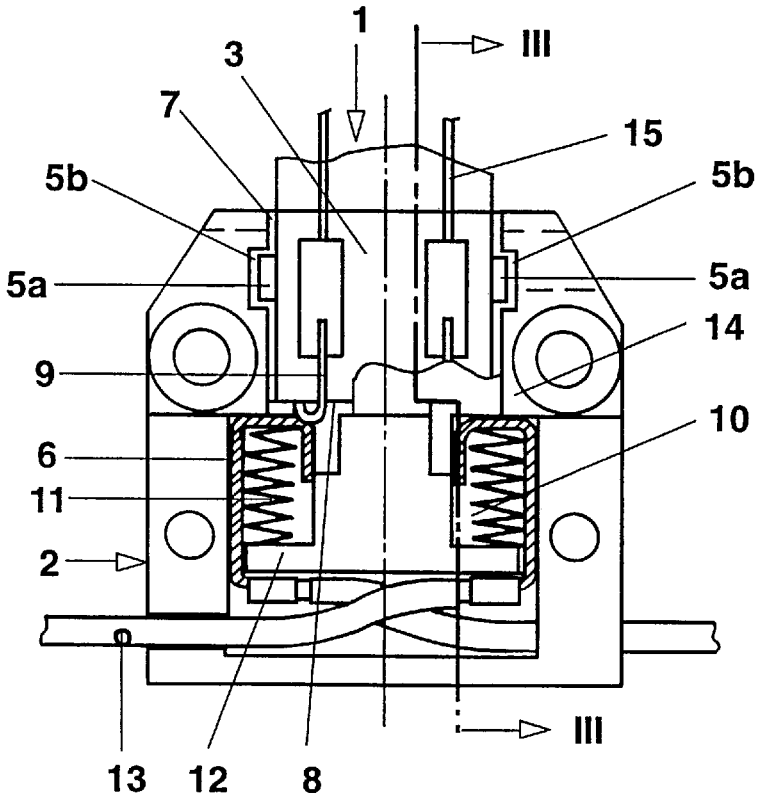
FIG. 2 shows a view of the internal design of the socket according to the first exemplary embodiment.
Figure 4A:
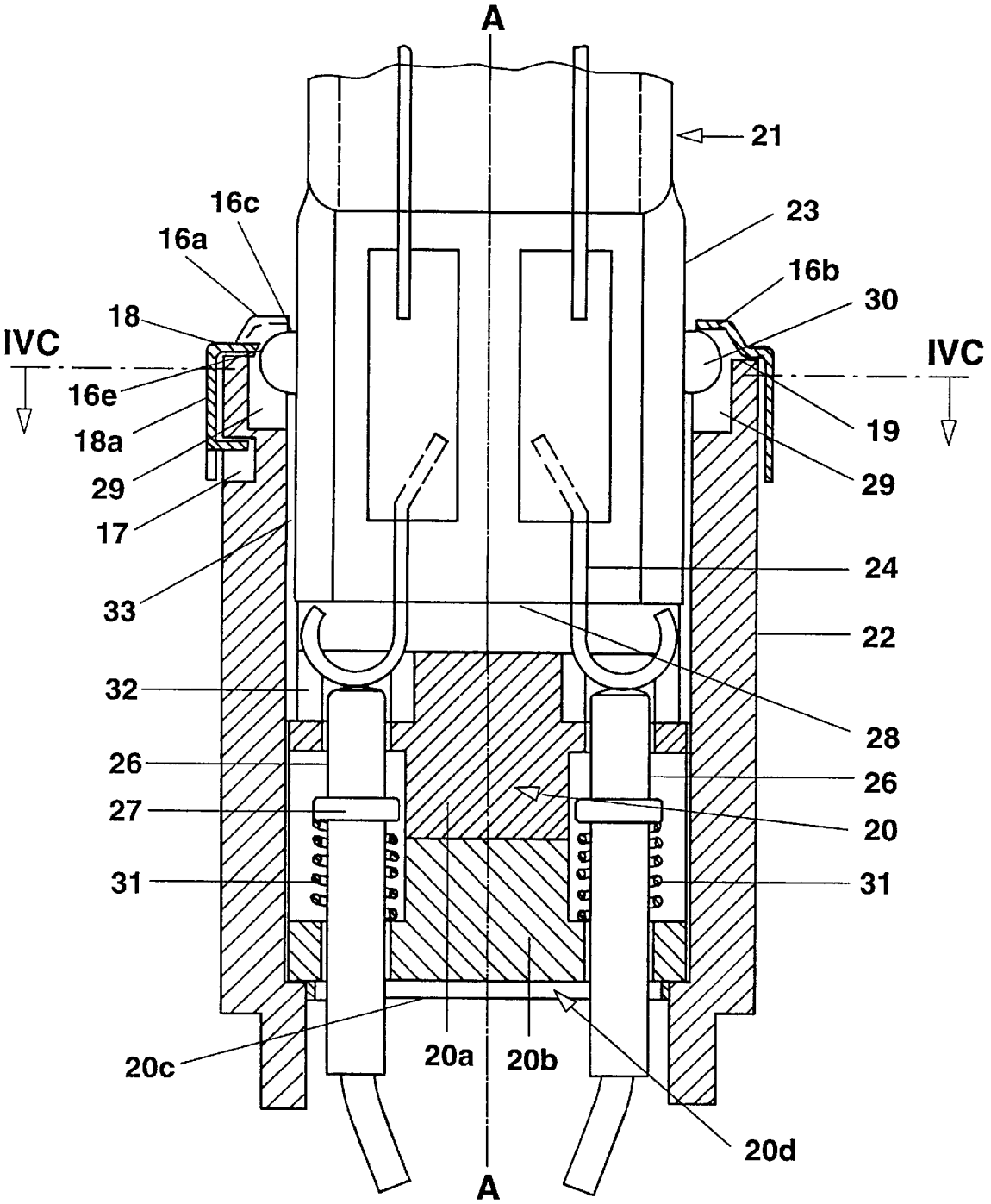
FIG. 4 shows a longitudinal section through a system composed of lamp and socket according to a second exemplary embodiment (FIG. 4*a*) as well as a top view of the socket from above (FIG. 4*b*) and from below (FIG. 4*d*) as well as a cross-section at the level of the cover (FIG. 4*c*)
Figure 4B:
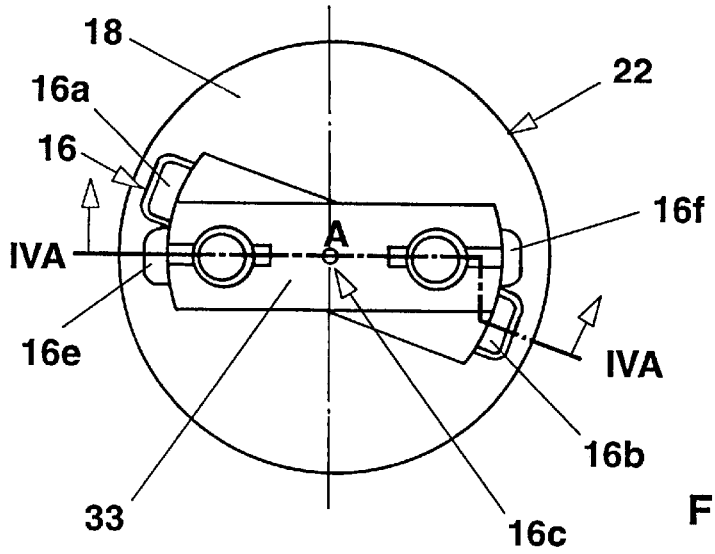
Figure 4C:
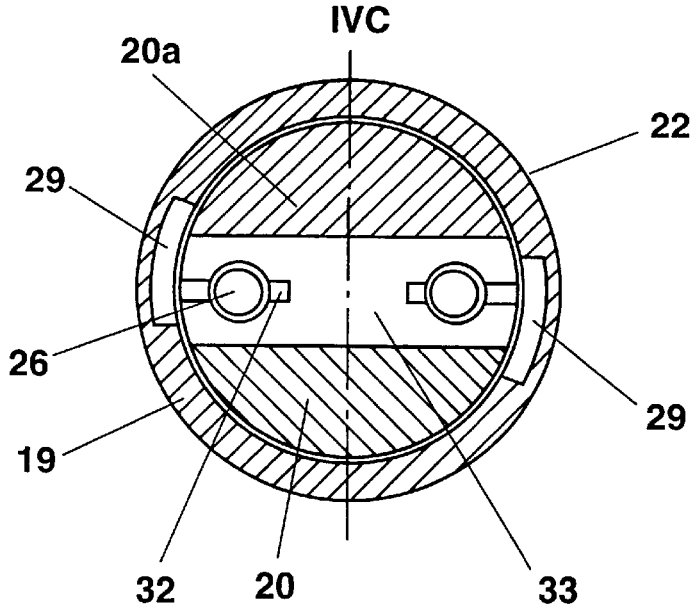
Figure 4D:
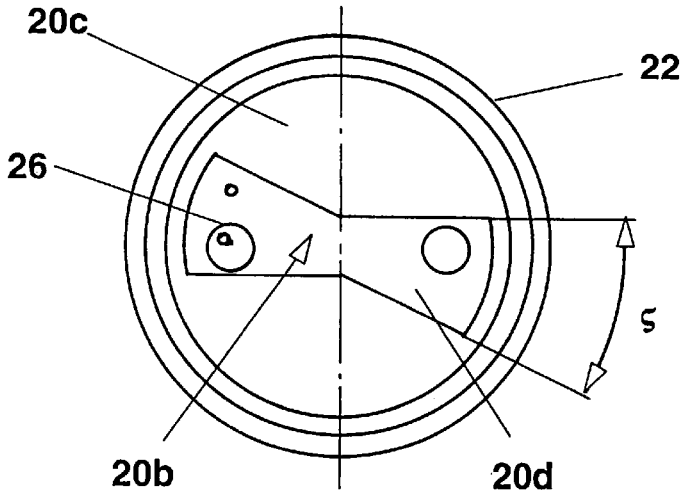

The first exemplary embodiment shows a tilting version of the system according to the invention and corresponds to the embodiment of a latching holder. The system is particularly suitable for table lamps, built-in furniture luminaires or the like. To be seen in FIGS. 1 to 3 is a high-voltage halogen incandescent lamp 1 which is plugged into a socket 2 and is held in an opening 7 of the essentially cuboidal socket 2 by means of its glass cap 3. The socket 2 is provided on one broad side with a riveted-on plate-shaped cover 4 which has been omitted in the view according to FIG. 2 for the sake of clarity. In turn, the cover is shown in FIG. 3 on the right-hand edge of the section orthogonal to FIG. 2. The entire extremely compact system is only 62 mm high overall, and the diameter of the lamp is 13 mm. The socket is 26 mm wide and 26 mm high as well as 11 mm deep. As FIG. 2 shows, the lamp has two supply leads 9, which project from the end face 8 of the pinch and are bent over outwards in the shape of a semicircle.

It is well in evidence from FIG. 3 that the lamp 1 can be inserted in an inclined fashion into the opening 7 because of the oblique upper edge 4a of the cover 4. In this case, the supply leads 9, shown in FIG. 2, of the lamp press downwards the contacts 6 of the socket 2, which are shaped like a bow, bent to resemble a "C" and are sprung in the interior of the "C" with helical springs 11. This is possible because the contacts 6 are guided in shafts 10, with the result that the lamp 1 can be inserted deeper under pressure. The lamp is then tilted into the longitudinal axis A. In this process, rotation takes place about an axis of rotation situated horizontally in the plane of the paper in FIG. 2 and perpendicular to the plane of the paper in FIG. 3, as a result of which boss-like projections 5*a* on the glass cap 3 of the lamp can be guided below a recess in a latching holder 5*b*. If the pressure is reduced and the lamp 1 is finally let go, the springs 11, which are seated on transverse webs 12 in the socket 2, press the lamp upwards into the recess in the latching holder 5*b*, and, on the one hand, the lamp is held securely and, on the other hand, there is a secure contact between the contacts 6 and the lower piece of the bow of the supply leads 9 of the lamp.

Illustrated in the lower region of the figures in each case are two cables 13 which are fastened to the contacts 6 by means of cable lugs, or are riveted or welded to the contacts.

It is to be seen in FIG. 2 and FIG. 3, in particular, that the live parts of the socket 2, specifically the contacts 6, are partly covered by the collar 14 grouped around the opening 7, that is to say the upper region of the socket 2. This collar 14 has the latching holder 5*b* and closely surrounds the glass cap 3. It is matched to the glass cap 3 as far as possible with a slight play. Apart from this close fit between the glass cap 3 and insertion opening 7, only the oblique upper edge 4, required for the inclined insertion, of the cover 4 is to be seen, as on the right in FIG. 3.

A particularly good covering of the live parts of the socket is achieved by means of a second embodiment, specifically a rotating version of the system according to the invention. In this case, the glass cap of the lamp in principle imitates a bayonet cap, see the second exemplary embodiment shown in FIGS. 4*a* to 4*d*, which corresponds to the configuration of a latching holder. By contrast with the first, however, the second exemplary embodiment has a greater overall height of the socket, with the result that it cannot be designed quite so flat, as becomes plain from the following. A particular advantage of this embodiment is that the socket can easily be tailored to the width of the pinch of the lamp, with the result that this width can be chosen freely.

Here, the socket is a hollow cylindrical body 22 made from ceramic or steatite, in which a separate cylindrical inner body 20 is mounted rotatably about the longitudinal axis A. The inner body 20 comprises two parts 20*a* and 20*b*, which are arranged one above another and through which two contact pins 26 extend parallel to the axis A. Said pins are resiliently mounted by means of helical springs 31 which stop against collars 27 of the pin contacts. Starting from its upper end face 19, the upper part 20*a* of the inner body has a slot-shaped holder 33 which is matched to the glass cap of the lamp to be held.

As the longitudinal section (FIG. 4*a*) and the top view (FIG. 4*b*) show, mounted on the upper end face 19, constructed as annular collar, of the socket is a cover 18 which is made from sheet metal and has an edge 18*a* which is drawn down circumferentially on the outside on the annular collar. The cover 18 is part of a latching holder, and is fastened by crimping three lateral depressions 17 of the socket (respectively spaced apart by 120°). The cover 18 further has an elongated camber 16 on its surface. It comprises two outer camber parts 16*a* and 16*b* which are separated from one another in the middle by an aperture 16*c* resembling a sector or a double fan. Furthermore, next to the camber parts 16*a, b* mirror-symmetric aperture parts 16*e* and 16*f* offset in each case by an angle of rotation of approximately 20° with respect to the camber parts are attached outwardly to the large aperture 16*c*. The shape of the entire aperture corresponds essentially to the cross-section of the pinch of a lamp, taking account of an axial rotation of 20°.

A high-voltage halogen incandescent lamp 21 pinched at one end and having a pinch designed as a glass cap 23 is inserted vertically from above into the hollow cylindrical socket 22 through the aperture 16*c* in the cover 18 into the holder 33 in the upper part 20*a* of the inner body. Two projections 30, in the shape of a hemisphere or boss, on the narrow sides of the glass cap 23 of the lamp in this case fit exactly through the aperture parts 16*e* and 16*f* (see the left-hand half of FIG. 4*a* and FIG. 4*b*) and come to be situated in bow-shaped cutouts 29 in the collar of the socket 22 (see FIG. 4*c*). A 20° rotation of the lamp 21 about the central axis A rotates the two projections 30 under the corresponding camber parts 16*a* and 16*b* of the cover 18 (FIG. 4*b*), as shown in the right-hand half of FIG. 4*a*. In this case, the entire inner part 20, which contains the pin contacts 26 with the springs 31, is also rotated. It is expedient to limit the maximum possible angle of rotation ξ by an end plate 20*c*, which is arranged directly below the inner body 20. It has a cutout 20*d* which is similar in shape to a bow-tie and correspondingly limits the angle of rotation ξ (see FIG. 4*d*).

When the lamp 21 is inserted into the holder 33, supply leads 24 of the lamp, which are bent over outwards in a semicircular shape and which are guided out of the end face 28 of the glass bulb 23, also press against the pin contacts 26 of the socket 22, which are spring-loaded by the separate helical springs 31. In this case, the supply leads 24 are guided in groove-like depressions 32 on the floor of the holder 33. Pressing down the pin contacts 26 permits the bosses 30 to come below the level of the cover 18, with the result that the rotation can be executed until the bosses 30 are located below the cambers 16*a*, 16*b*. When the lamp 21 is released, the springs 31 press the lamp so high again that the bosses 30 latch in the cambers 16*a*, 16*b*. The lamp is releasably locked.

The following exemplary embodiments all correspond to the embodiment of a snap-action or plug-in version. This embodiment is particularly preferred because in principle it unites the advantages of the previous exemplary embodiments and can moreover be realized in a particularly simple way and provides an extremely compact system.

In this case, an HV lamp/socket system having a maximum diameter of 22 mm and an overall length of not more than 51 mm (up to 60 W power) or 57 mm (up to 100 W power) is realized for the first time, something which appeared out of reach up till now.

Figure 5A:
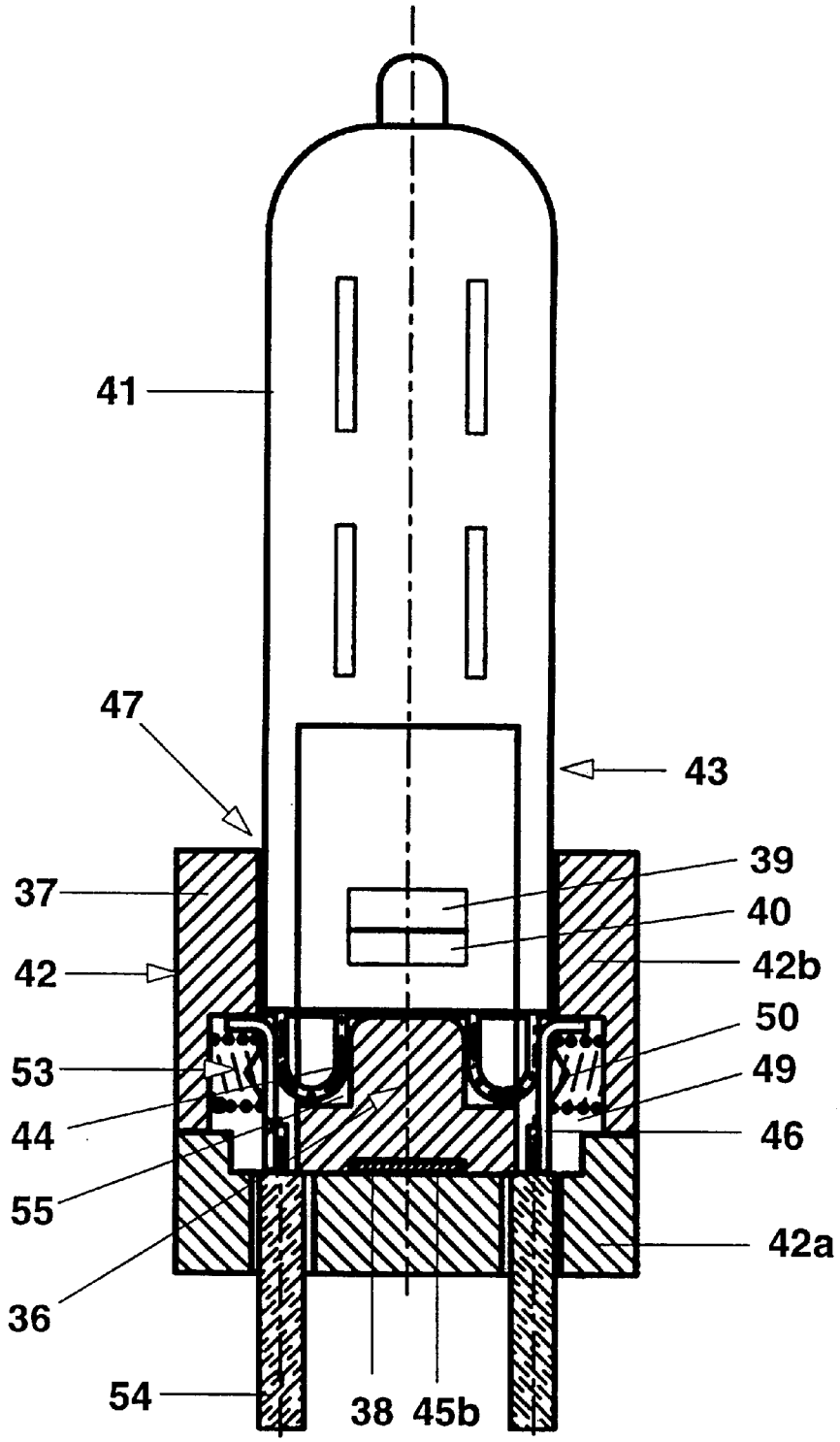
FIG. 5 shows two longitudinal sections rotated by 90° to each other (FIGS. 5*a* and 5*b*) of a system composed of lamp and socket according to a third exemplary embodiment.
Figure 5B:
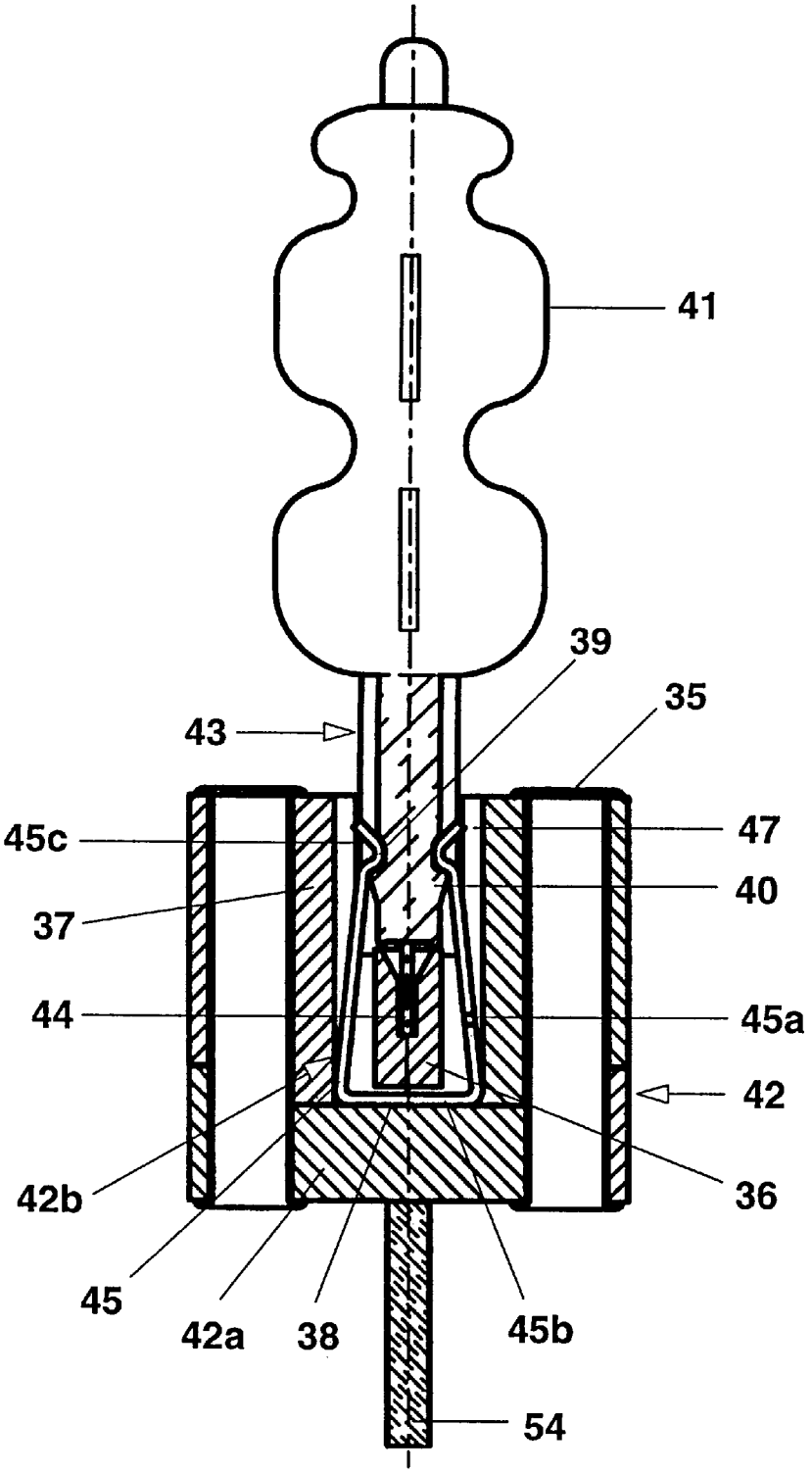

FIGS. 5 and 6 show the third exemplary embodiment in cross-sectional representations rotated by 90° relative to one another (FIGS. 5*a* and 5*b*), as well as details (FIG. 6). A high-voltage halogen incandescent lamp 41 having a pinch-sealed glass cap 43 in the shape of a double T in cross-section can be inserted into an insertion opening 47 in a socket 42 perpendicularly from above.

The socket 42 is a round cylinder having a total height of 17 mm and a diameter of 22 mm. It comprises a bottom part 42*a*, in the shape of a small plate, and a top part 42*b* with the insertion opening 47. The two parts are riveted to one another (35). The insertion opening 47 terminates at a base part 36 and is surrounded by a collar 37.

Fastened in the insertion opening 47 is a holding clamp 45 which is bent in a U-shaped fashion and whose two limbs 45*a* are bent inwards slightly. The connecting piece 45*b* connecting the limbs 45*a* is locked in a connecting channel 38 on the lower end face of the base part 36.

The lamp is held mechanically as follows: upon insertion of the lamp, the limbs 45*a* of the holding clamp (which forms a latching holder) fitted in the insertion opening 47 latch with their rounded concavely bent over ends 45*c* over a wedge-shaped projection 40 in the broad side of the glass cap into a complementary groove-like recess 39, on the glass cap 43, arranged thereabove and adjacent thereto.

Figure 6A:
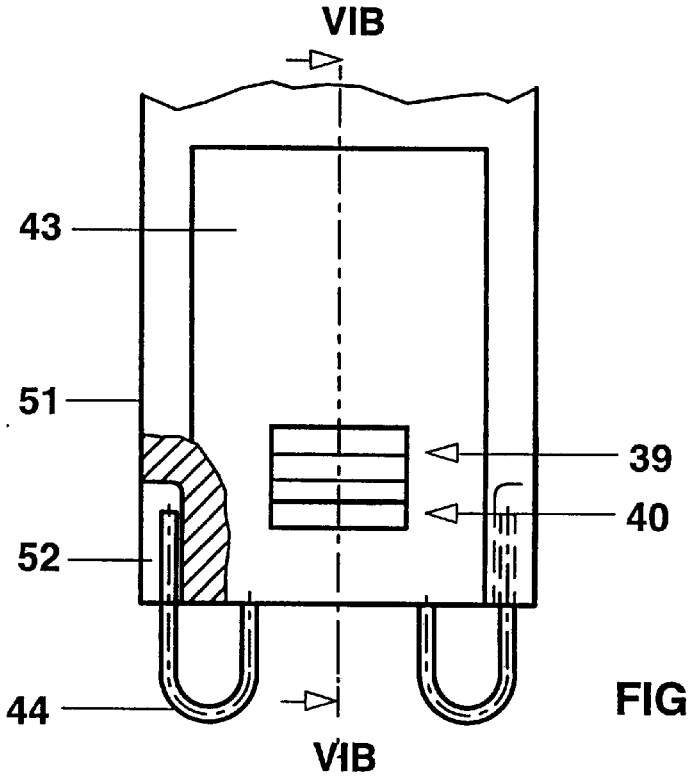
FIG. 6 shows various details of the exemplary embodiment in accordance with FIG. 5, concerning the lamp (FIGS. 6*a–c*) and concerning the contacts (FIGS. 6*d–f*)
Figure 6B:
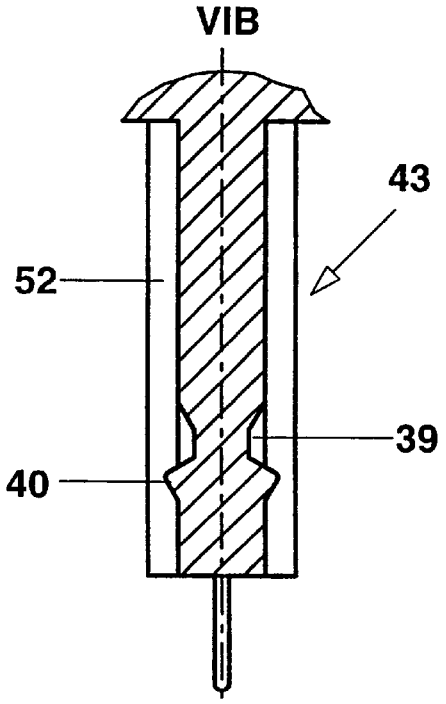
Figure 6C:
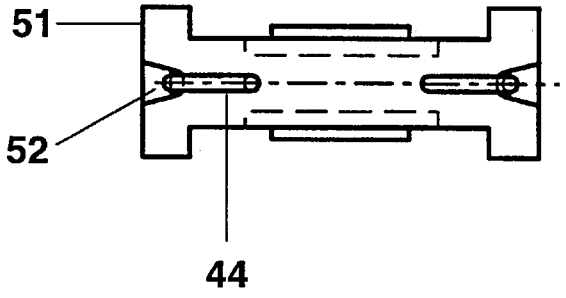
Figure 6D:
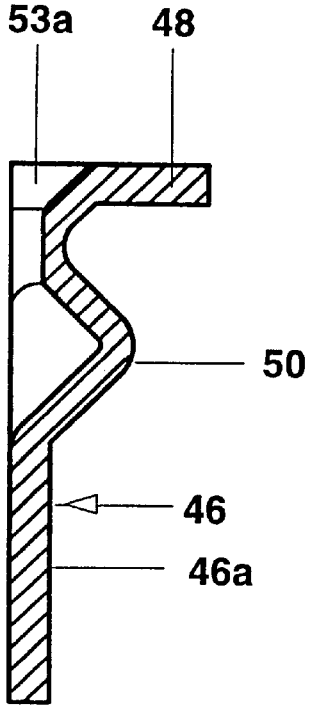
Figure 6E:
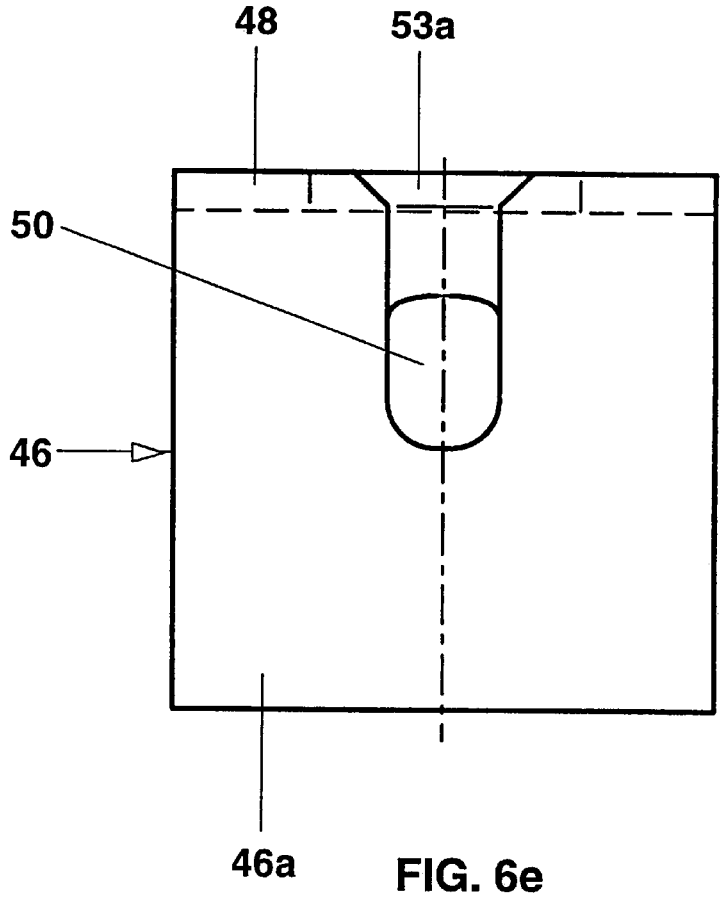
Figure 6F:
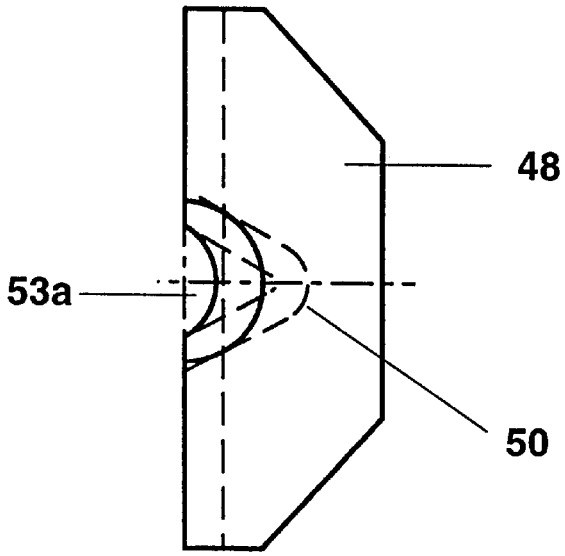

Making the electric contact of the lamp is performed as follows: in accordance with FIGS. 6*a* to 6*c*, two supply leads 44 emerge at a spacing of 12 mm at the lower end face of the glass cap. They comprise wires 0.5 mm thick. The latter are firstly guided outwards in a straight line for about 4 mm, but then bent back in the shape of a semicircle and lengthened so much that they are guided, and thus stabilized, in axially parallel grooves 52 on the narrow sides 51 of the pinch.

Upon insertion of the lamp, the supply leads 44 push sheet metal contacts 46 of the socket, which are arranged below the glass cap 43, slightly outwards radially against the force of separate helical springs 53, and thereby produce an electric contact. The contacts 46 have an upper lip 48 which is bent away at right angles radially outwards on the basic body 46*a*. The upper lip facilitates sliding of the contact 46 in a cavity 49 which is provided for this purpose and is fitted on the side in the collar 37. The springs 53, situated transverse to the axis of the lamp, are fixed to the base face 46*a* of the contact by means of a bulging projection 50. The force transmission from the supply lead 44 onto the contact 46 is facilitated by a dent 53*a*, directed obliquely outwards, in the bending region between the basic body 46*a* and upper lip 48. Thus, in this embodiment the contact point between the supply lead and socket contact is situated outside to the side on the outer limb of the supply leads 44, which are bent over by 180° in the shape of a semicircle.

This type of making contact is optimized in every respect, since the bow formed by the supply lead creates a satisfactory spacing of the contact point from the glass cap. Thermal problems are thereby minimized. On the other hand, fixing the supply lead in the groove ensures a high stability of this design. At the same time, the bow encourages a gradually rising transmission of force onto the contact upon insertion of the lamp. Finally, a very long common contact surface between the contact and supply lead is also rendered possible thereby, as a result of which transition resistances are reduced and corrosion problems caused by heat are avoided.

This type of design for making contact permits the contact spacing to be differentiated with respect to LV lamps, with the result that erroneous insertion of LV lamps is prevented from the very first. Accidents due to erroneous insertion of low-voltage halogen incandescent lamps are therefore impossible in this exemplary embodiment, because latching the latching holder 5 does not require a counterforce on the part of the contacts 6 or the springs 11.

The supply leads 44 are guided in guide shafts 55 which are situated in the base part 36 of the upper part of the socket 42. The lower part contains two bores for feeder cables 54, which are fastened to the lower end of the contacts 46.

FIGS. 5*a* and 5*b* show that the insertion opening 47 in the wide direction is matched to the dimensions of the broad side of the pinch of the glass cap 43. It still leaves a sufficient space in the narrow direction for the bent ends 45*c* of the holding clamp 45 to be sprung out. By comparison with the first two exemplary embodiments, the overall result is a substantially smaller insertion opening 47 accompanied by optimum shock protection of the contacts 46, which otherwise are also largely covered by their lateral arrangement.

Figure 9:
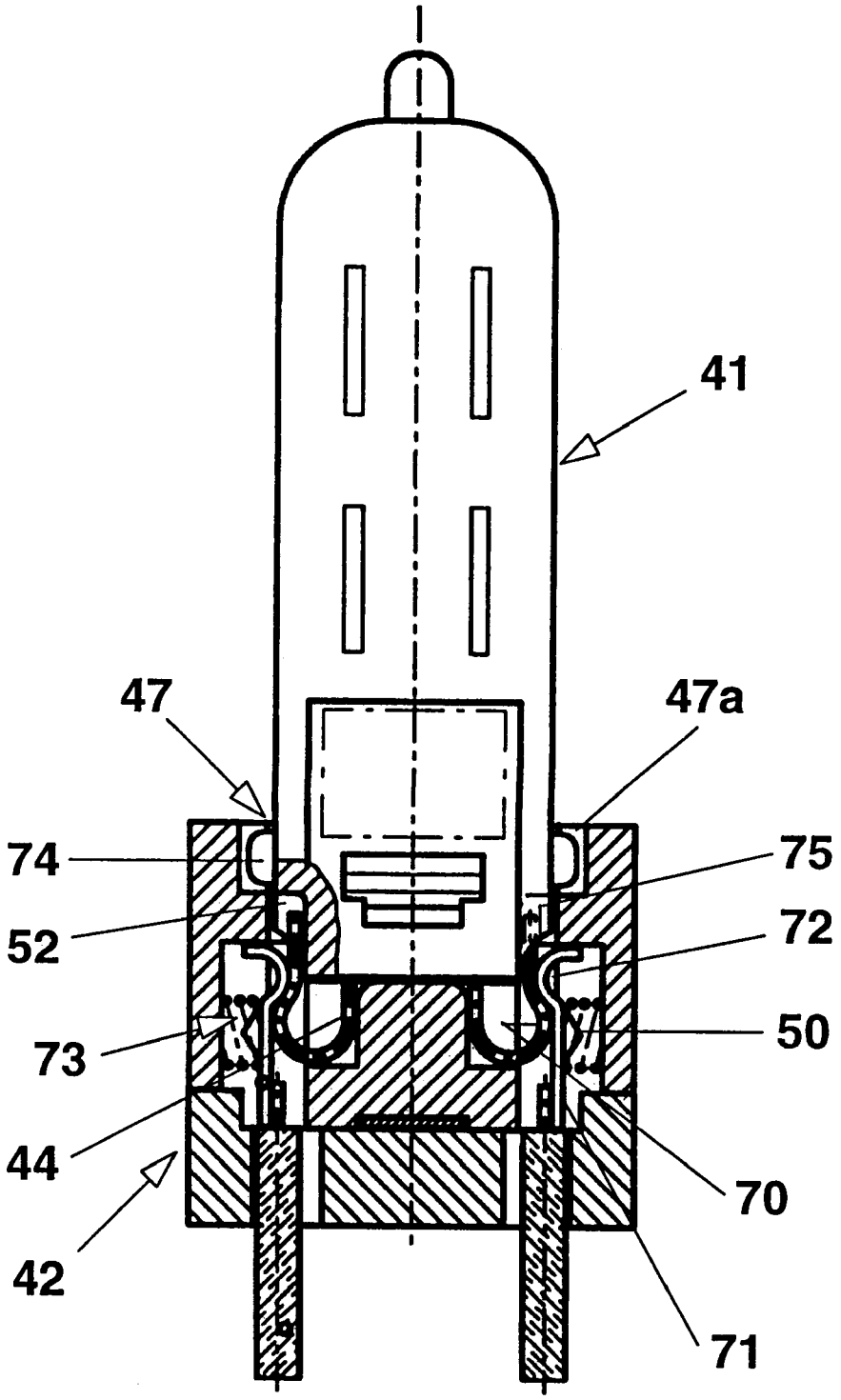
FIG. 9 shows a further exemplary embodiment, slightly modified with respect to FIG. 5.

The separate holding clamp 45 is dispensed with in a version in accordance with FIG. 9, which is simplified and more cost-effective by contrast with FIGS. 5/6. The mechanical holding is performed, rather, in a similar fashion to that in the first exemplary embodiments. It is produced by means of the cooperation of the sheet metal contacts, moved by the transversely situated helical springs, with suitably shaped external supply leads. Identical components to those in FIG. 5 are provided in FIG. 9 with identical reference symbols.

In this case, the outer part of the external supply lead 44 (that is to say the part which adjoins the 180° bend outside) is not bent back in a straight line towards the narrow side of the pinch (and mounted there in the groove 52); it additionally bulges outwards. It firstly describes in the plane of the supply leads, directly after the curvature, a bow 70 directed outwards. The sheet metal contact 71 has an appropriately matched, inwardly directed bend 72 of semicircular shape, with the result that the contact 71 resembles a question mark when seen from the side. In the end position, the bend 72 is arranged higher than the bow 70, with the result that it can latch behind the bow 70. The latch region is preferably at the level of a lateral quarter-circle-type cutout 75 in the end of the pinch. Shear forces acting on the supply leads, which consist of molybdenum, are minimized as a result.

Upon insertion of the lamp, the small spring-loaded contact plate is pressed outwards briefly upon passing the bow 70. Upon reaching the end position, the bend 72 latches behind the bow 70. The transverse helical spring 73, which presses the contact 71 from outside against the supply lead 44, is now arranged at the level of the bow 70. Its pressure presents inadvertent disconnection of the latching connection. In connection with the contacts, the supply leads thus effect not only the electric connection but also the mechanical holding.

In order to prevent a certain play of the lamp in the insertion opening 47, projections 74 resembling bosses are fitted on the narrow sides of the pinch and are guided in vertical guide shafts in the wall of the insertion opening 47, and thus prevent the lamp from tilting sideways.

Figure 7:
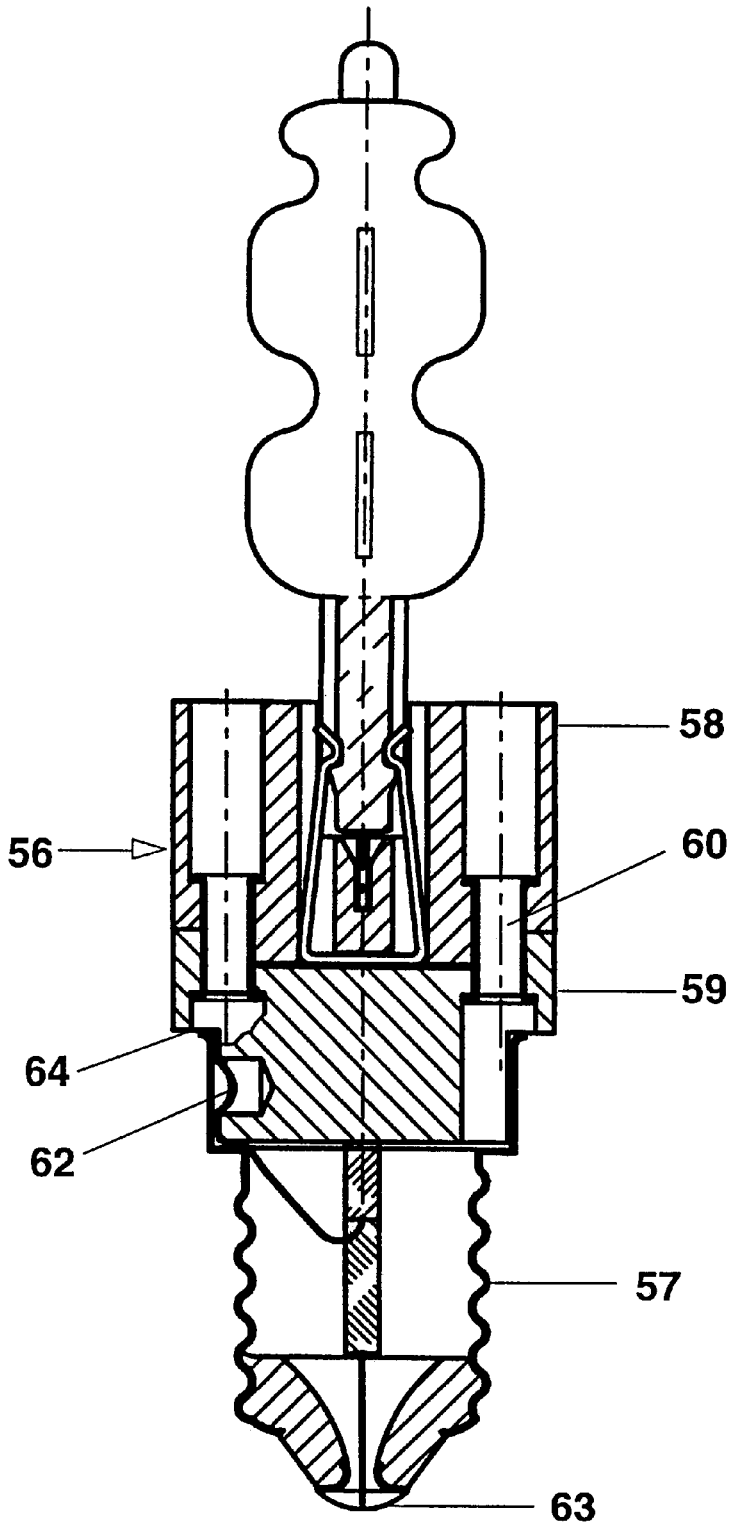
FIG. 7 shows a for the most part longitudinally sectioned view of a system composed cf lamp and socket according to an adapter version.
Figure 8:
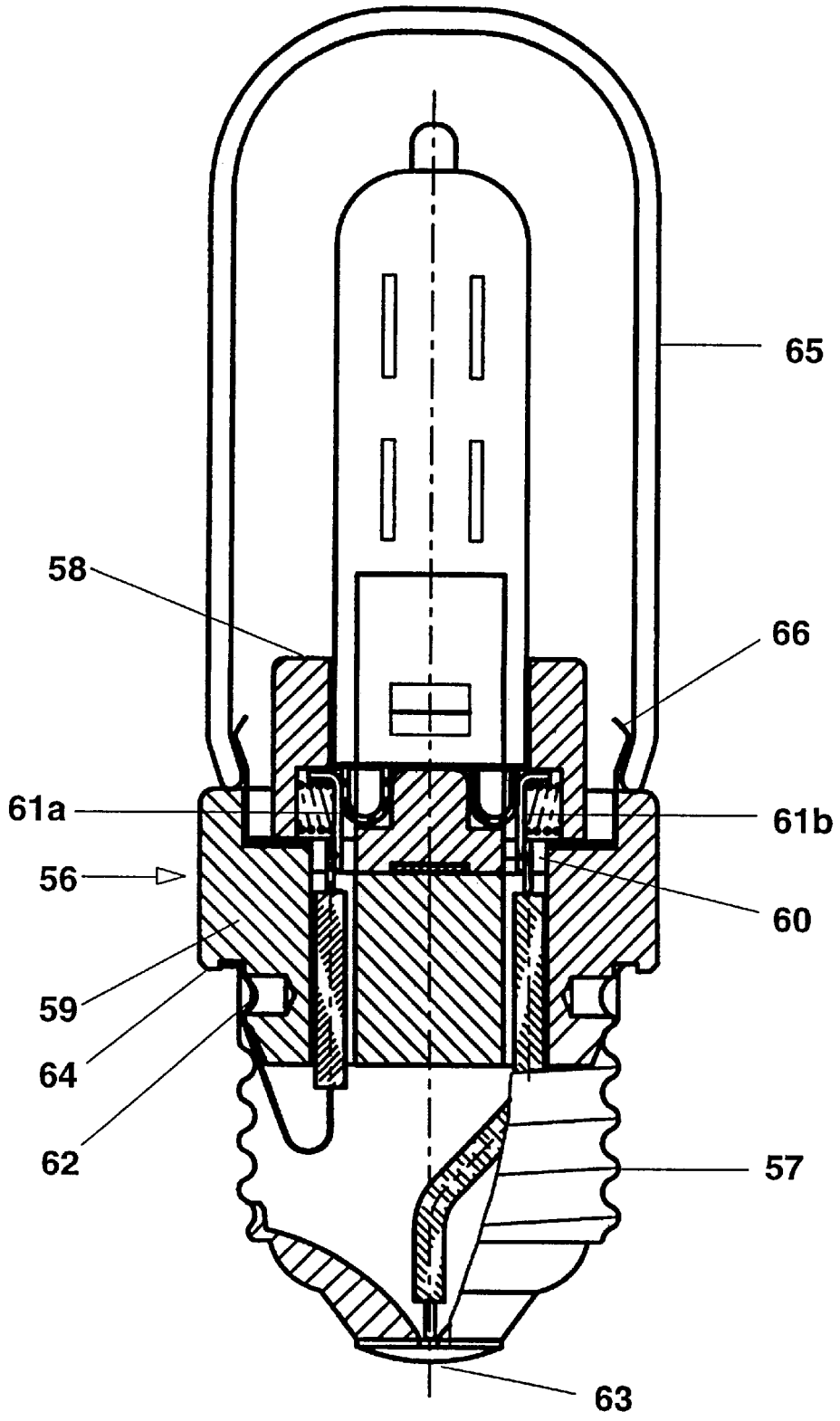
FIG. 8 shows a longitudinal section, rotated by 90° with respect to FIG. 7, of a further exemplary embodiment which is modified slightly with respect to FIG. 7.

FIGS. 7 and 8, which show two side views rotated by 90°, correspond largely to FIG. 5. However, they show two adapter versions in which, instead of a fixed assembly of the socket in a luminaire, an adapter 56 now replaces the socket part. The adapter 56 has a top part 58, which corresponds in principle to that described in FIGS. 5/6. The bottom part 59, which is fitted with a screw cap 57, is fastened to the top part via two hollow rivets 60. A cable leading from a first contact 61*a* to the side contact 62 of the screw cap is clamped into the bottom part 59 by means of crimping, while a second cable leads from the contact plate 63 of the E27 cap to a second contact 61*b*. The remaining components correspond to the previous exemplary embodiment. In the embodiment of FIG. 7, the bottom part has an E14 screw cap. The overall height of the system is 81 mm. In the embodiment of FIG. 8, the bottom part has an E27 screw cap, and moreover an outer bulb 65 is also slipped over the inner bulb. The outer bulb is fastened to the bottom part 59 by means of spring sheets 66. The overall height is approximately 90 mm.

It is particularly worthy of mention that the lateral overhang 64 (2.5 mm width) at the adapter ensures shock protection in both exemplary embodiments. It therefore replaces the outer bulb (FIG. 7) previously mandatory or renders the outer bulb 65 a purely design feature (FIG. 8).

The bottom part of the adapter can also be provided with a bayonet cap instead of a screw cap. Furthermore, instead of an outer bulb it is also possible, for example, to fasten a reflector or decorative satinfrosted (translucent opal) glass envelope on the adapter. In this case, a funnel-shaped, conical or bell-shaped opal screen is attached as an open glass envelope 14, in a way similar to the adapter shown in German Utility Model 92 01 057. In this previously known adapter system, the lamp is, however, fitted with a conventional bayonet cap (type B15*d*) and the adapter is fitted with the corresponding mating component. The overall length is therefore substantially greater than in the case of the solution according to the invention.

Instead of the opal screen, it is equally conceivable to provide an arbitrarily shaped separate glass bulb which is detachably fastened to the socket 2, for example screwed, in order to be able to reach the lamp. Of course, any other auxiliary components of a lamp or luminaire are also conceivable, for example filters, mirrors, lenses or more such.

The following are used as materials in the exemplary embodiments: molybdenum for the lamp supply leads; ceramic, preferably processed ceramic or heat-resistant plastic, for the parts of the socket or of the adapter; nickel-plated iron or nickel-plated copper alloy for the rivets, spring steel for the spring of the latching holder in the case of FIGS. 5 to 9; copper alloys or nickel-plated iron for the contacts 6; and silicone-insulated cables at the contacts 6.

In the exemplary embodiments shown in FIGS. 5 to 8, the socket 2 is assembled as follows: the holding spring 5 is plugged from below into the top part of the socket 2; the cables are fastened to the contacts 6 by riveting or resistance welding. The cables are inserted with the contacts and the springs 11, and the bottom part and the top part of the socket 2 are riveted by the rivets 12; if appropriate, the standard cap shell 8 is mounted on the bottom part and crimped.

The spacing of the contacts 6 achieved in the exemplary embodiments shown in FIG. 5 ff. is clearly larger than the standard spacing of LV lamps (6.3 mm). It is at least 7 mm, preferably 9.6 mm. Of course, there is also otherwise the need to provide appropriate clearances matched to the voltage and creepage paths.

What is claimed is:

1. A halogen incandescent lamp (1;21;41) including a bulb having at one end a pinch with two broad sides and two narrow sides and in which a filament is arranged that is connected to external supply leads (9;24;44) which emerge from the end face of the pinch that is averted from the bulb, the external supply leads being bent over by at least approximately 90°, characterized in that the lamp (1;21;41) is a high-voltage or medium voltage halogen incandescent lamp having a lamp axis (A), the pinch being constructed as glass cap (3;23;43) in that it is provided with a holding means for the fastening of a socket, the external supply leads (9;24;44) of the lamp being bent over in the direction towards the narrow sides of the pinch.

2. The lamp according to claim 1, characterized in that the holding means is a recess (39) or a projection (5*a*;30;40) for latching a complementary latching holder of a socket.

3. The lamp according to claim 1, characterized in that the supply leads (44) are bent over at a spacing from the glass cap (43) and, in particular, are guided back at least near to the glass cap (43) and, in particular, bear against the narrow sides of the pinch.

4. The lamp according to claim 3, in which the bentover ends of the supply leads (4) lie in grooves (52) in the glass cap (3).

5. The lamp according to claim 1, characterized in that an inherent safety effect is achieved by suitably constructing the internal supply leads (15) of the lamp.

* * * * *